US007557503B2

(12) United States Patent
Inagaki et al.

(10) Patent No.: US 7,557,503 B2
(45) Date of Patent: Jul. 7, 2009

(54) STREAK TUBE INCLUDING CONTROL ELECTRODE HAVING BLOCKING PORTION BETWEEN A PHOTOCATHODE AND AN ANODE

(75) Inventors: Yoshinori Inagaki, Hamamatsu (JP); Toshiharu Ai, Hamamatsu (JP); Kuniyoshi Mori, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 440 days.

(21) Appl. No.: 11/230,921

(22) Filed: Sep. 21, 2005

(65) Prior Publication Data

US 2006/0061273 A1 Mar. 23, 2006

Related U.S. Application Data

(60) Provisional application No. 60/611,750, filed on Sep. 22, 2004.

(30) Foreign Application Priority Data

Sep. 22, 2004 (JP) ..... P2004-276067

(51) Int. Cl.
*H01J 40/06* (2006.01)

(52) U.S. Cl. ..... 313/530; 313/529; 250/208.1; 250/214 VT; 250/214 R

(58) Field of Classification Search ..... 313/529, 313/530, 537, 540, 542, 543; 250/214 VT, 250/208.1, 214 R; 348/215.1
See application file for complete search history.

(56) References Cited

U.S. PATENT DOCUMENTS 4,310,857 A * 1/1982 Lieber et al. ..... 348/215.1

(Continued)

FOREIGN PATENT DOCUMENTS

JP 01-315932 12/1989

(Continued)

OTHER PUBLICATIONS

K. Kinoshita et al., "Femtosecond Streak Tube", SPIE vol. 1982 Photoelectronic Detection and Imaging, 1993.*

(Continued)

*Primary Examiner*—Joseph L Williams
*Assistant Examiner*—Aaron Williams
(74) *Attorney, Agent, or Firm*—Drinker Biddle & Reath LLP

(57) ABSTRACT

A streak tube 1A comprises an envelope 10 including an entrance faceplate 12; a photocathode 20 for converting light received from the entrance faceplate 12 into an electron; an anode 23 having an opening 23*a* for passing there through the electron emitted from the photocathode 20; deflecting electrodes 24 for controlling a deflection of the electron having passed through the opening 23*a* of the anode; and a fluorescent screen 25 for detecting a streak image due to the electron having the deflection controlled by the deflecting electrodes 24. The photocathode 20 is configured so as to be kept from directly facing the anode 23 on an axis of an electric field formed between the entrance faceplate 12 and the anode 23 or on a tube axis passing the center of the opening 23*a* in the anode 23 within the envelope 10. Thus, the streak tube capable of suppressing influences of noise signals on signals corresponding to incident light can be realized.

6 Claims, 7 Drawing Sheets

U.S. PATENT DOCUMENTS

| | | | | |
|---|---|---|---|---|
| 4,902,927 | A * | 2/1990 | Kinoshita | 313/376 |
| 6,194,700 | B1 * | 2/2001 | Pradere et al. | 250/214 VT |
| 6,628,072 | B2 * | 9/2003 | Craig et al. | 313/542 |
| 7,227,116 | B2 * | 6/2007 | Gleckler | 250/208.1 |
| 2003/0146698 | A1 * | 8/2003 | Ohtomo et al. | 313/542 |
| 2004/0031906 | A1 * | 2/2004 | Glecker | 250/208.1 |
| 2008/0035834 | A1 * | 2/2008 | Gleckler | 250/208.1 |

FOREIGN PATENT DOCUMENTS

| | | |
|---|---|---|
| JP | 03-134943 | 6/1991 |
| JP | 03-152840 | 6/1991 |
| JP | 06-23669 | 3/1994 |
| JP | 09-139183 | 5/1997 |

OTHER PUBLICATIONS

A. Gelbart et al., "Flash Lidar Based on Multiple-Slit Streak Tube Imaging Lidar", SPIE vol. 4723, 2002.*
JP1997139183 Translation.*

* cited by examiner

STREAK TUBE INCLUDING CONTROL ELECTRODE HAVING BLOCKING PORTION BETWEEN A PHOTOCATHODE AND AN ANODE

CROSS-REFERENCE TO RELATED APPLICATION

This application claims priority to Provisional Application Ser. No. 60/611,750 filed Sep. 22, 2004, which is hereby incorporated by reference in its entirety.

BACKGROUND OF THE INVENTION

1. Field of the Invention

The present invention relates to a streak tube by which a temporal change of light to be detected is detected as a streak image.

2. Related Background of the Invention

A streak tube causes a photocathode to convert light to be detected into electrons (photoelectrons), and detects a temporal change of electrons as a streak image, thereby measuring the change in incident light with time. In general, such a streak tube employs one face of an airtightly closed envelope as an entrance faceplate, whereas a photocathode, a deflecting electrode for controlling the deflection of electrons emitted from the photocathode so as to generate a streak image, and detecting means such as a fluorescent screen for detecting thus generated streak image are arranged within the envelope successively from the entrance faceplate side (see, for example, Patent Document 1: Japanese Patent Application Laid-Open No. H3-152840, and Patent Document 2: Japanese Patent Application Laid-Open No. H9-139183).

SUMMARY OF THE INVENTION

In the above-mentioned streak tube, a configuration in which an anode having an opening is disposed between the photocathode and deflecting electrode, so that electrons having passed through the opening of the anode after being emitted from the photocathode are guided to the deflecting electrode is considered. When the electrons from the photocathode are passed through the opening of the anode while being converged in such a configuration, internal gases may be ionized in the vicinity of a crossover point at which a group of photoelectrons converge near the anode.

When ions thus generated in the vicinity of the anode return to the photocathode (ion feedback) because of an electric field within the envelope, unnecessary secondary electrons due to the ions occur in the photocathode. The secondary electrons reach the fluorescent screen by way of the anode and deflecting electrode as with the photoelectrons due to the incident light, and thus are detected as noise signals. Such noise signals are detected as pseudo signals which are temporally retarded from original signals corresponding to the incident light, and thus are problematic when measuring the temporal change in incident light according to the streak image as mentioned above.

In order to overcome the foregoing problems, it is an object of the present invention to provide a streak tube which can suppress the influence of noise signals on signals corresponding to incident light.

For achieving such an object, the present invention provides a streak tube comprising (1) an envelope including an entrance faceplate for entering light to be detected; (2) a photocathode, disposed within the envelope, for converting the light received from the entrance faceplate into an electron; (3) an anode having an opening for passing there through the electron emitted from the photocathode; (4) a deflecting electrode for controlling a deflection of the electron having passed through the opening of the anode; and (5) detecting means for detecting a streak image due to the electron having the deflection controlled by the deflecting electrode after being emitted from the photocathode; (6) wherein the photocathode is configured so as to be kept from directly facing the anode on an axis of an electric field formed between the entrance faceplate and the anode within the envelope.

In another aspect, the present invention provides a streak tube comprising (1) an envelope including an entrance faceplate for entering light to be detected; (2) a photocathode, disposed within the envelope, for converting the light received from the entrance faceplate into an electron; (3) an anode having an opening for passing there through the electron emitted from the photocathode; (4) a deflecting electrode for controlling a deflection of the electron having passed through the opening of the anode; and (5) detecting means for detecting a streak image due to the electron having the deflection controlled by the deflecting electrode after being emitted from the photocathode; (6) wherein the photocathode is configured so as to be kept from directly facing the anode on a tube axis passing a center of the opening of the anode within the envelope.

In each of the above-mentioned streak tubes, a photocathode, an anode having an opening, a deflecting electrode, and detecting means are arranged within an envelope successively from the entrance faceplate side. In a configuration seeing the photocathode from the anode side in a direction opposite from the direction in which photoelectrons emitted from the photocathode in response to the incident light are guided to the detecting means, the anode (including the opening) and the photocathode are kept from directly facing each other on the axis of the electric field or the tube axis. In such a configuration, even if ions are generated near the anode when electrons pass through the opening of the anode, thus generated ions will be prevented from reaching the photocathode because of the electric field within the envelope. This can prevent unnecessary secondary electrons due to ions from occurring, thereby suppressing the influence of noise signals on signals corresponding to the incident light.

In the above-mentioned configuration of the streak tube, "the photocathode is kept from directly facing the anode on a predetermined axis" refers to a configuration in which the photocathode is not directly visible from the anode (a predetermined position within the opening of the anode) as seen on the axis. Examples of this configuration include a configuration in which the photocathode itself is arranged off axis and a configuration in which an other member is disposed on the axis between the photocathode and the anode.

For the "axis of an electric field formed between the entrance faceplate and the anode", when the electric field is formed substantially symmetrical about an axis, the axis of symmetry (center axis) corresponds to the axis of the electric field. The "tube axis passing a center of the opening of the anode" corresponds to the structural center axis of the streak tube. An axis which passes the center of the opening of the anode and is perpendicular to the anode usually becomes the tube axis. Preferably, the above-mentioned streak tube comprises a converging electrode, disposed between the photocathode and the anode, for converging the electron emitted from the photocathode into the opening of the anode.

In the streak tube in accordance with the present invention, in a configuration seeing the photocathode from the anode side within the envelope, the anode and the photocathode are kept from directly facing each other on the axis of the electric field or the tube axis, so that ions generated in the vicinity of the anode are prevented from reaching the photocathode because of the electric field within the envelope. This prevents unnecessary secondary electrons due to ions from occurring and suppresses the influence of noise signals on signals corresponding to the incident light.

DESCRIPTION OF THE PREFERRED EMBODIMENTS

Figure 1:
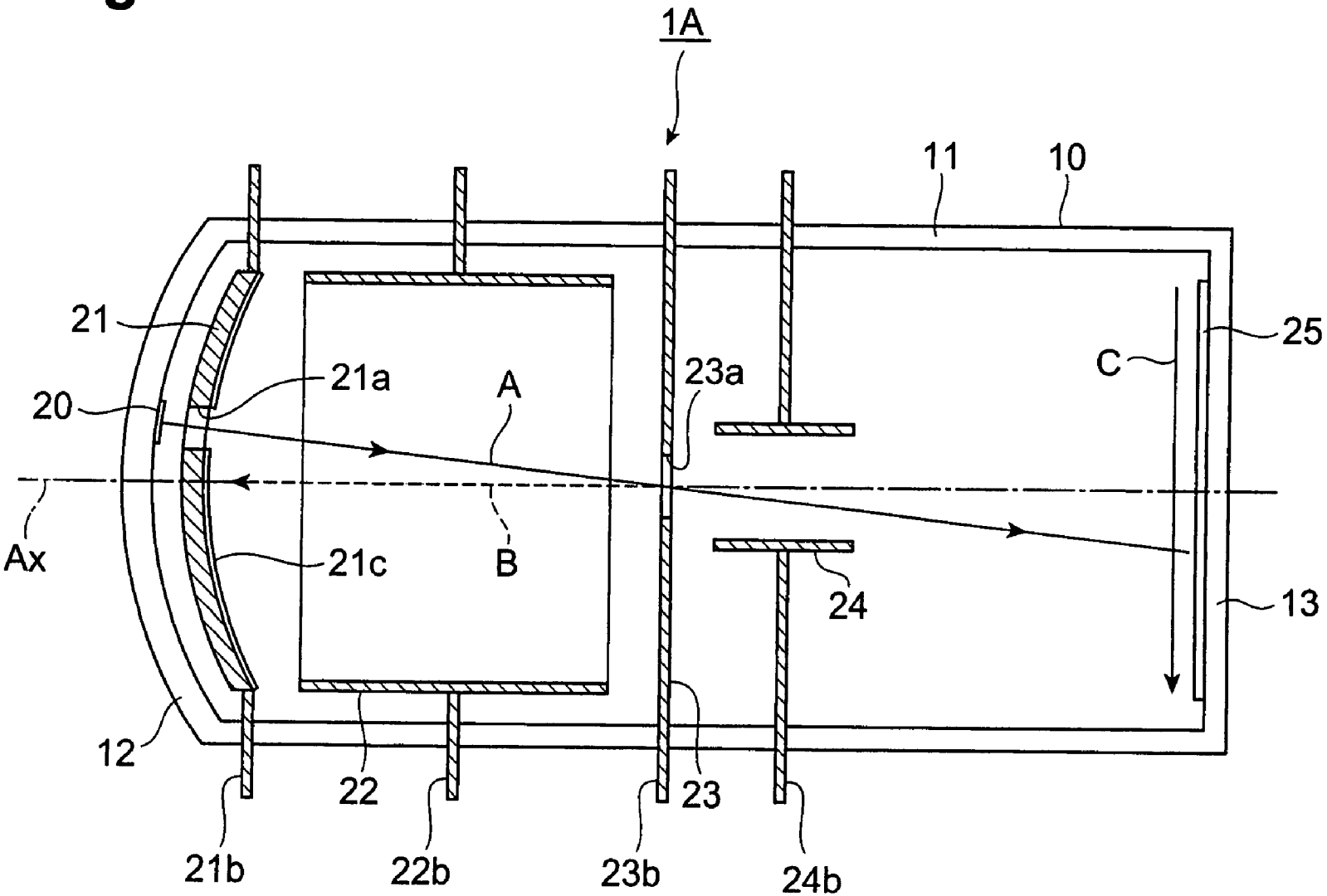
FIG. 1 is a side sectional view showing a configuration of a first embodiment of a streak tube.

In the following, preferred embodiments of the streak tube in accordance with the present invention will be explained in detail with reference to the drawings. In the explanation of the drawings, constituents identical to each other will be referred to with numerals identical to each other without repeating their overlapping descriptions. Ratios of dimensions in the drawings do not always match those explained.

Figure 2:
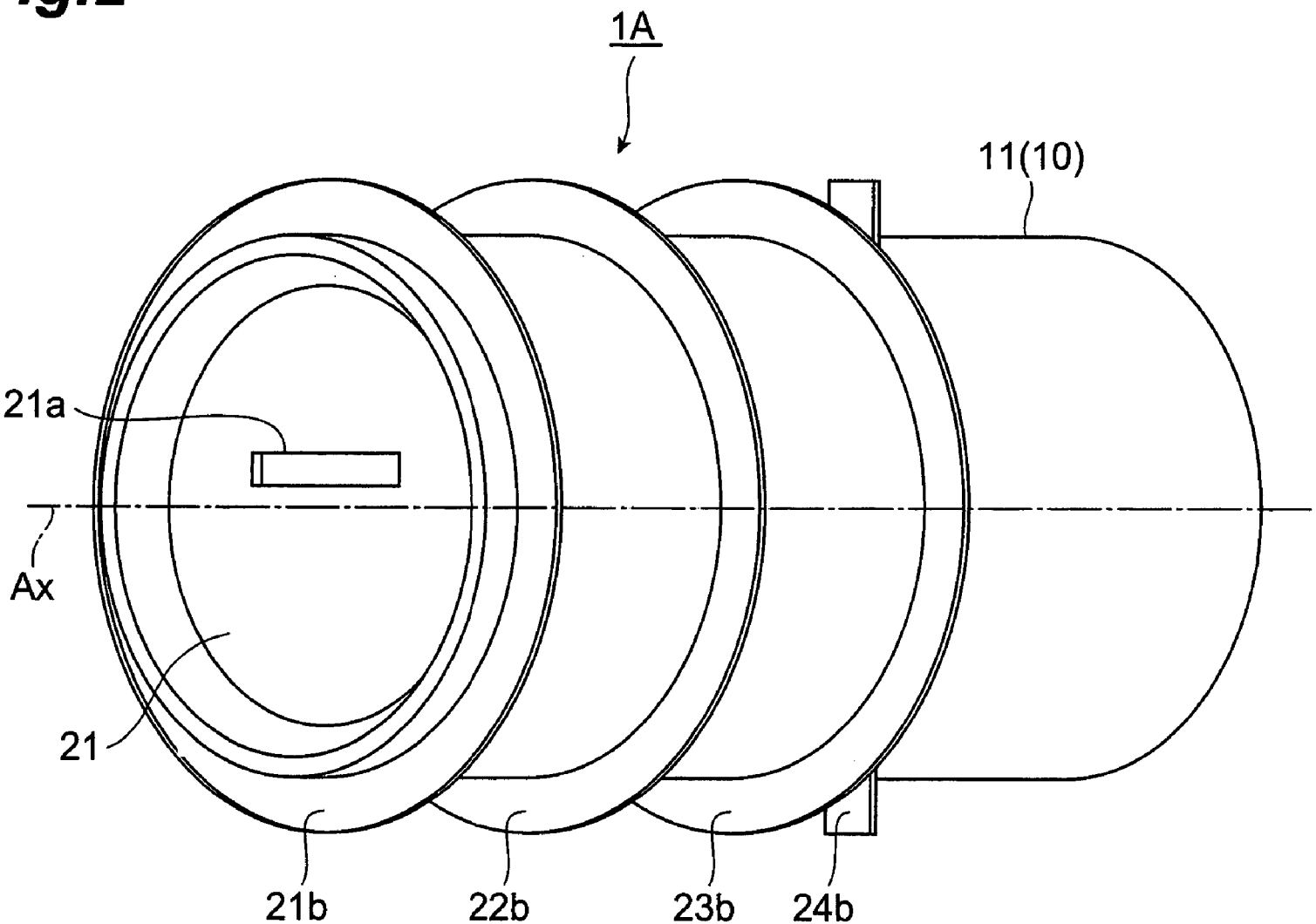
FIG. 2 is a perspective view showing an exterior configuration of the streak tube shown in FIG. 1.

FIG. 1 is a side sectional view showing the configuration of a first embodiment of the streak tube in accordance with the present invention. FIG. 2 is a perspective view showing the exterior configuration of the streak tube shown in FIG. 1. FIG. 2 does not depict an entrance faceplate, which will be explained later, in an envelope constituting the outer peripheral part of the streak tube. In FIG. 1, a solid arrow A indicates the trajectory of an electron emitted from the photocathode, a dashed arrow B indicates the trajectory of an ion generated near the anode, and a solid arrow C indicates an electron sweeping direction due to a deflecting electrode. An axis Ax shown in FIG. 1 indicates the center axis of this streak tube 1A.

The streak tube 1A in accordance with this embodiment is equipped with an envelope 10 formed as being airtightly closed by a material such as glass, the inside of which is held at a high vacuum. The envelope 10 includes a tubular part 11 having a cylindrical form whose center axis is the axis Ax, an entrance faceplate 12 provided on one side of the tubular part 11, and an output faceplate 13 provided on the other side of the tubular part 11.

The entrance faceplate 12 functions as an entrance window for entering light to be detected, and is formed from a material transmitting a predetermined wavelength of light there through. A photocathode 20 is formed on the inner face of the entrance faceplate 12 (the surface on an anode 23 side which will be explained later). The photocathode 20 functions as a transmission type photoelectric surface converting the light incident thereon from the entrance faceplate 12 into an electron (photoelectron). In the streak tube 1A, as shown in FIG. 1, the photocathode 20 is formed at a predetermined part on the inner face of the entrance faceplate 12 excluding the intersection with the axis Ax.

On the other hand, the output faceplate 13 positioned on the side opposite from the entrance faceplate 12 with the axis Ax is used for outputting a streak image generated in the streak tube 1A. A fluorescent screen 25 is formed on the inner face of the output faceplate 13. The fluorescent screen 25 is detecting means for detecting the streak image due to the electron.

In addition to the photocathode 20 and fluorescent screen 25 mentioned above, a gate electrode 21, a converging electrode 22, an anode 23, and deflecting electrodes 24 are placed within the envelope 10 successively from the entrance faceplate 12 side to the output faceplate 13 side.

The anode 23 has a center part formed with an opening 23*a* for passing there through the electron emitted from the photocathode 20. The anode 23 is substantially perpendicular to the axis Ax, whereas its opening 23*a* has a predetermined form employing the axis Ax as a center axis. In such a configuration, the axis Ax substantially coincides with the tube axis passing the center of the opening 23*a* of the anode 23. The tube axis corresponds to the structural center axis of the streak tube 1A and is an axis substantially perpendicular to the anode 23.

Deflecting electrodes (sweep electrodes) 24 are provided between the anode 23 and the fluorescent screen 25 acting as detecting means. The deflecting electrodes 24 are electrodes for controlling the deflection of the electron having passed through the opening 23*a* of the anode. Specifically, the deflecting electrodes 24 are constructed by a pair of electrodes which are parallel to the axis Ax and arranged so as to hold the axis Ax there between.

As a consequence, when a sweep voltage is applied between the pair of electrodes 24 in synchronization with incidence of light to be detected, the electron traveling from the photocathode 20 to the fluorescent screen 25 is swept in the direction of arrow C. Here, the fluorescent screen 25 acting as detecting means detects a streak image due to the electron whose deflection is controlled by the deflecting electrodes 24 after being emitted from the photocathode 20. The streak image obtained at that time is an image corresponding to the temporal change in incident light because of the electron sweeping mentioned above. For simplifying the illustration, FIG. 1 schematically shows the electron trajectory A assuming that the electron travels straightforward.

On the other hand, the gate electrode 21 and converging electrode 22 are provided between the photocathode 20 and anode 23. In these electrodes, the converging electrode 22 is an electrode for converging the electron emitted from the photocathode 20 into the opening 23*a* of the anode 23. Specifically, the converging electrode 22 is an electrostatic converging electrode constructed by a tubular electrode having a cylindrical form whose center axis is the axis Ax.

The gate electrode 21 has an opening 21*a* passing there through the electron emitted from the photocathode 20, and is arranged at a predetermined position between the photocathode 20 and the converging electrode 22. The gate electrode 21 is a control electrode which controls a condition under which the electron from the photocathode 20 passes through the opening 21*a* to the anode 23. Specifically, the gate electrode 21 controls a gate operation for detecting the streak image in the streak tube 1A by applying a gate voltage.

In the streak tube 1A, as shown in FIGS. 1 and 2, the opening 21*a* of the gate electrode 21 is formed at a predetermined part excluding the intersection with the axis Ax. In this embodiment, the opening 21*a* of the gate electrode 21 is formed with an opening form like a slit, whose longitudinal direction is perpendicular to the sweeping direction C, in a predetermined part excluding the intersection with the axis Ax while being shifted therefrom by a predetermined distance in a direction opposite from the arrow in the electron sweeping direction indicated by the arrow C in FIG. 1 as seen from the axis Ax. A specific example of such a configuration is one in which a slit-like opening 21*a* having a width of 5 mm in the electron sweeping direction is formed such that its center is shifted from the axis Ax by 4.5 mm.

The photocathode 20 formed on the inner face of the entrance faceplate 12 is formed with an outer shape corresponding to the form of the opening 21*a* in the gate electrode 21. The opening 23*a* in the anode 23 has a form taking account of the electron converging condition due to the converging electrode 22 while placing its center axis at the axis Ax as mentioned above, e.g., a circular form centered at the axis Ax.

When predetermined voltages are applied to the photocathode 20, gate electrode 21, converging electrode 22, and anode 23, respectively, in the foregoing configuration, a predetermined electric field for guiding the electron emitted from the photocathode 20 to the deflecting electrodes 24 and fluorescent screen 25 is formed between the entrance faceplate 12 and anode 23 within the envelope 10. The electric field at that time is substantially symmetrical about the axis Ax, whereas the axis of symmetry (center axis) is the axis of the electric field. In such a configuration, the axis Ax substantially coincides with the axis of the electric field formed between the entrance faceplate 12 and the anode 23. Namely, the axis Ax substantially coincides with both of the tube axis and electric field axis in the streak tube 1A in this embodiment.

In this streak tube 1A, the photocathode 20 on the inner face of the entrance faceplate 12 and the opening 21*a* in the gate electrode 21 are formed at respective positions shifted from the axis Ax by predetermined distances. Such a configuration keeps the photocathode 20 from directly facing the anode 23 on the axis Ax (electric field axis or tube axis) within the envelope 10 in this embodiment. In the perspective view of FIG. 2, electrode parts 21*b*, 22*b*, 23*b*, 24*b* projecting out of the envelope 10 so as to be used for applying voltage and so forth are shown for the respective electrodes 21, 22, 23, 24 constructing the streak tube 1A.

Effects of the streak tube 1A in accordance with this embodiment will be explained.

In the streak tube 1A shown in FIGS. 1 and 2, the photocathode 20, the anode 23 having the opening 23*a*, the deflecting electrodes 24, and the fluorescent screen 25 as detecting means are arranged within the envelope 10 successively from the entrance faceplate 12 side. In a configuration seeing the photocathode 20 from the anode 23 side in a direction opposite from the direction in which photoelectrons emitted from the photocathode 20 in response to incident light are guided to the fluorescent screen 25, the photocathode 20 does not directly face the anode 23 on the axis Ax (electric field axis or tube axis).

Even if an ion is generated in the vicinity of the anode 23 when an electron passes through the opening 23*a* of the anode 23, the above-mentioned configuration prevents thus generated ion from reaching the photocathode 20 because of the electric field within the envelope 10 as indicated by the ion trajectory B in FIG. 1. This prevents unnecessary secondary electrons due to ions from occurring, and suppresses the influence of noise signals on signals corresponding to incident light.

Figure 3:
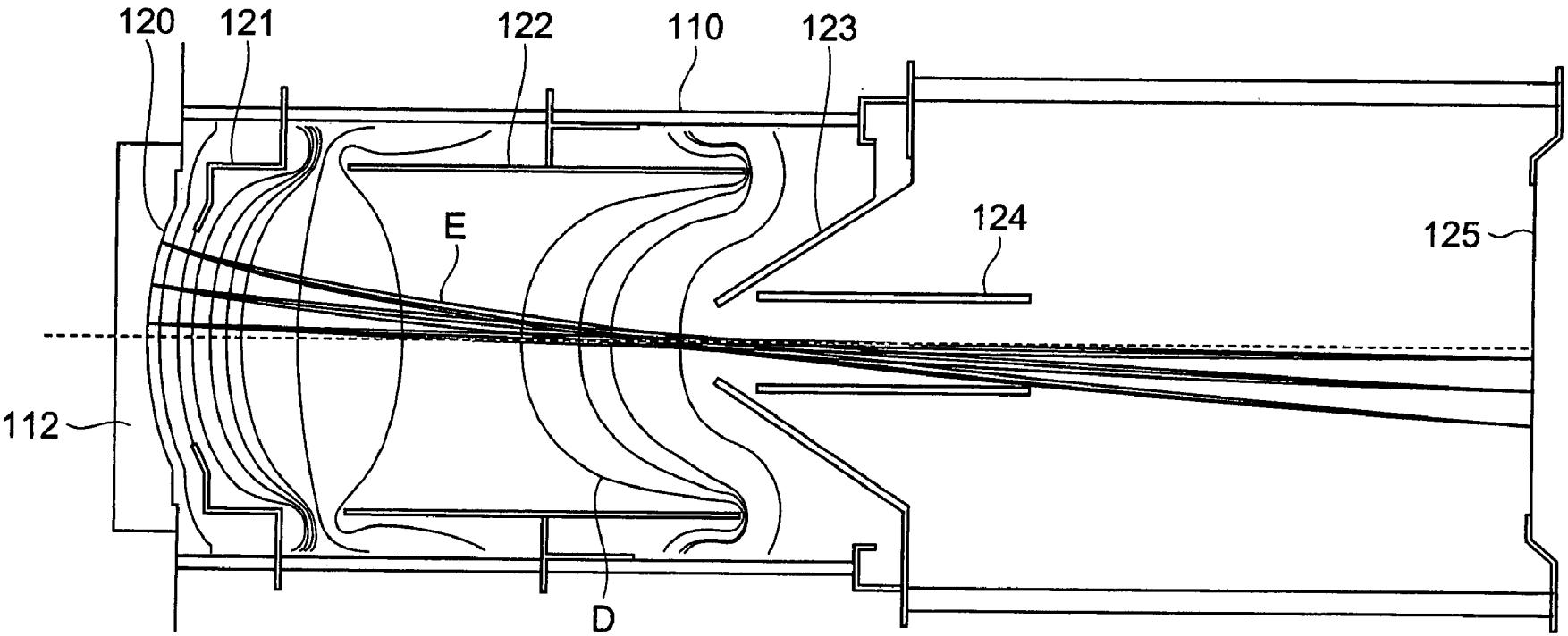
FIG. 3 is a view showing an example of an electric field and electron trajectories within the envelope of the streak tube.

FIG. 3 is a view showing an example of an electric field and electron trajectories in an envelope of a streak tube. FIG. 3 shows general examples of electric fields and electron trajectories in the streak tube, whereas its configuration differs from that of the streak tube 1A shown in FIGS. 1 and 2. Assuming that the voltage at the photocathode 120 is 0 V, the voltage at the gate electrode 121 is 130 V, the voltage at the converging electrode 122 is 2420 V, and the voltage at the anode 123 is 15 kV in the depicted configuration, FIG. 3 shows an electric field D formed between the entrance faceplate 112 and anode 123 within the envelope 110, and electron trajectories E from the photocathode 120 to the fluorescent screen 125.

In such a configuration, electrons from the photocathode pass through the opening of the anode while converging. Here, at a crossover point where a group of photoelectrons converge in the vicinity of the center part of the anode, the density of passing electrons increases, thereby raising the probability of an internal gas being ionized. In this case, many of the ions generated in the vicinity of the anode return to the vicinity of the center of the photocathode (ion feedback; see the trajectory B in FIG. 1) along the axis substantially regardless of the photoelectron trajectory (see the trajectory A in FIG. 1) causing the ions to occur. These ions collide with the photocathode, whereby unnecessary secondary electrons due to the ions occur in the photocathode.

By contrast, the streak tube 1A in accordance with this embodiment has a configuration in which the anode 23 (including the opening 23*a*) and the photocathode 20 do not directly face each other on the axis Ax (electric field axis or tube axis) within the envelope 10 as mentioned above. In such a configuration, ions generated in the vicinity of the anode 23 move in a trajectory substantially extending along the axis Ax as mentioned above, and thus can effectively be prevented from reaching the photocathode 20.

Thus preventing ions from reaching the photocathode 20 and thereby suppressing the occurrence of unnecessary secondary electrons is quite effective in measuring temporal changes in incident light by using the streak images. Though the sensitivity of a photocathode seems to deteriorate because of ion feedback in a streak tube when operated for a long time or when detecting a signal having a high intensity, the above-mentioned configuration suppresses such a deterioration in sensitivity of the photocathode.

Here, a streak tube is configured to comprise an envelope including an entrance faceplate for entering light to be detected; a photocathode, disposed within the envelope, for converting the light received from the entrance faceplate into an electron; an anode having an opening for passing there through the electron emitted from the photocathode; a deflecting electrode for controlling a deflection of the electron having passed through the opening of the anode; and detecting means such as a fluorescent screen for detecting a streak image due to the electron having the deflection controlled by the deflecting electrode after being emitted from the photocathode; whereas the photocathode is configured so as to be kept from directly facing the anode on a predetermined axis (an axis of an electric field formed between the entrance faceplate and the anode within the envelope, or a tube axis passing the center of the opening of the anode within the envelope). As mentioned above, such a configuration can prevent ions generated in the vicinity of the anode from reaching the photocathode because of the electric field within the envelope. This prevents unnecessary secondary electrons due to ions from occurring, and suppresses the influence of noise signals on signals corresponding to the incident light.

In the above-mentioned configuration of the streak tube, "the photocathode is kept from directly facing the anode on a predetermined axis" refers to a configuration in which the photocathode is not directly visible from the anode (a predetermined position within the opening of the anode) as seen on the axis. Examples of this configuration include a configuration in which the photocathode itself is arranged off axis and a configuration in which an other member is disposed on the axis between the photocathode and the anode.

For the "axis of an electric field formed between the entrance faceplate and the anode", when the electric field is formed substantially symmetrical about an axis, the axis of symmetry (center axis) corresponds to the axis of the electric field. The "tube axis passing a center of the opening in the anode" corresponds to the structural center axis of the streak tube. An axis which passes the center of the opening of the anode and is perpendicular to the anode usually becomes the tube axis. The same axis Ax acts as the electric field axis and tube axis in the streak tube 1A having the configuration shown in FIG. 1, as mentioned above. When the electric field axis and the tube axis differ from each other, it will be satisfactory if at least one axis satisfies the configurational condition mentioned above.

As a specific example of configurations of the above-mentioned streak tube, one in which the photocathode is formed at a predetermined part excluding an intersection with a predetermined axis (electric field axis or tube axis) on the surface (inner face) of the entrance faceplate on the anode side can be used. In FIG. 1, the photocathode 20 is formed at a part excluding the intersection with the axis Ax on the surface of the entrance faceplate 12 on the anode 23 side. In such a configuration, even when ions generated in the vicinity of the anode 23 reach the entrance faceplate 12 because of the electric field within the envelope 10, unnecessary secondary electrons due to the ions are not generated in the photocathode 20, since the photocathode 20 is not formed near the intersection with the axis Ax where the ions reach on the inner face of the entrance faceplate 12.

In the above-mentioned streak tube 1A, the gate electrode 21 as a control electrode having the opening 21*a* for passing there through the electron emitted from the photocathode 20 and controlling a condition under which the electron passes there through from the photocathode 20 to the anode 23 is arranged between the photocathode 20 and the anode 23. This can favorably control the detection of the streak image in the streak tube 1A. Electrodes other than the gate electrode may also be used as such a control electrode.

When the control electrode is thus provided, a configuration in which the opening of the control electrode is formed at a predetermined part excluding an intersection with a predetermined axis (electric field axis or tube axis) can be used as a specific example of configurations of the above-mentioned streak tube. In FIG. 1, the opening 21*a* of the gate electrode 21 as the control electrode is formed at a part excluding the intersection with the axis Ax. In such a configuration, even when ions generated in the vicinity of the anode 23 move toward the entrance faceplate 12 because of the electric field within the envelope 10, the ions reach the surface of the gate electrode 21 on the anode 23 side on and near the axis Ax without reaching the entrance faceplate 12 and photocathode 20, whereby unnecessary secondary electrons due to the ions do not occur in the photocathode 20.

In a configuration thus having a control electrode, it will be preferred if the surface of the control electrode on the anode side is processed for suppressing a secondary electron emission. This can restrain unnecessary secondary electrons due to ions in the control electrode from occurring and suppress the influence of noise signals on signals corresponding to incident light. This processing will later be explained in detail.

In the above-mentioned streak tube 1A, the converging electrode 22 for converging the electron emitted from the photocathode 20 into the opening 23*a* of the anode 23 is disposed between the photocathode 20 and the anode 23. This can favorably control electron trajectories within the envelope 10.

Here, in the case using a manufacturing method of forming the photocathode 20 by way of the opening 21*a* of the gate electrode 21 from the anode 23 side at the time of manufacturing the streak tube 1A shown in FIG. 1, a film capable of emitting secondary electrons is also formed on the surface of the gate electrode 21 on the anode 23 side as indicated by 21*c* in FIG. 1.

However, such a manufacturing method of the photocathode 20 forms the photocathode under such a condition that the photoelectric surface sensitivity becomes the highest on the inner face of the entrance faceplate 12, so that the film 21*c* on the gate electrode 21 yields a sensitivity lower than that of the photocathode 20, and a lower secondary electron emission efficiency when colliding with ions. Therefore, even when such a photocathode manufacturing method is used, the above-mentioned configuration can suppress the occurrence of unnecessary secondary electrons due to ions as a whole.

An example of such a photocathode manufacturing method comprises the steps of vapor-depositing antimony (Sb) on the inner face of the entrance faceplate 12 by way of the opening 21*a* of the gate electrode 21 from the anode 23 side, and then introducing an alkali so as to activate antimony such that the photoelectric surface sensitivity becomes the highest on the inner face of the entrance faceplate 12. When a manufacturing method with a transfer apparatus is used as a photocathode manufacturing method, no film capable of emitting secondary electrons is formed on the gate electrode. Therefore, the occurrence of unnecessary secondary electrons due to ions can further be suppressed.

The configuration of the streak tube in accordance with the present invention will further be explained.

Figure 4:
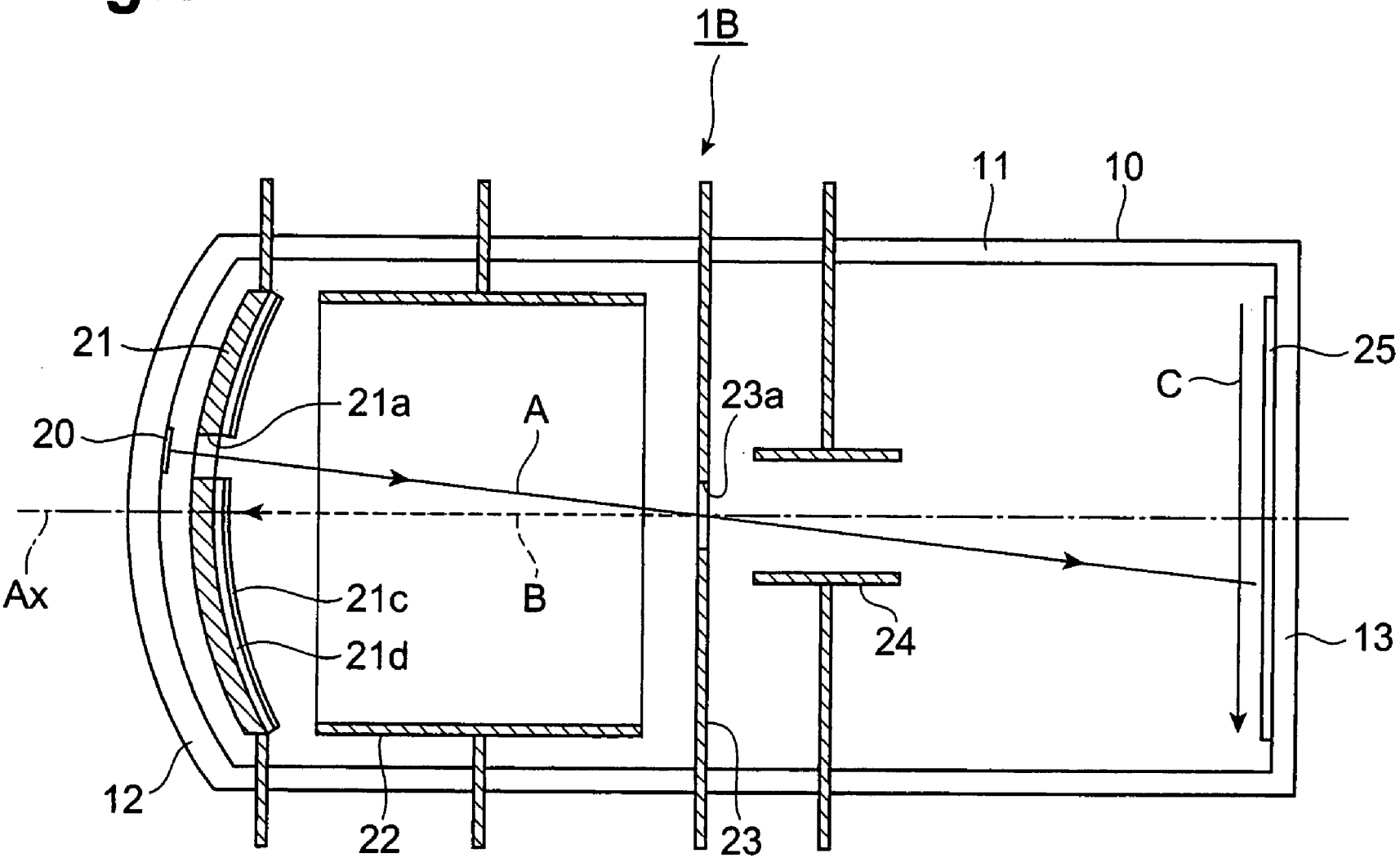
FIG. 4 is a side sectional view showing a configuration of a second embodiment of the streak tube.

FIG. 4 is a side sectional view showing the configuration of a second embodiment of the streak tube in accordance with the present invention. Configurations of an envelope 10, a photocathode 20, a converging electrode 22, an anode 23, deflecting electrodes 24, and a fluorescent screen 25 in the streak tube 1B in accordance with this embodiment are the same as those in the streak tube 1A shown in FIG. 1.

A gate electrode 21 is provided between the photocathode 20 and the anode 23. The gate electrode 21 has an opening 21*a* for passing there through an electron emitted from the photocathode 20 and is arranged at a predetermined position between the photocathode 20 and the converging electrode 22. In this streak tube 1B, the opening 21*a* of the gate electrode 21 is formed at a predetermined part excluding the intersection with the axis Ax.

Further, in this embodiment, a film 21*d* made of a material lowering the secondary electrode emitting capability (photoelectric surface sensitivity) is formed on the surface of the gate electrode 21 on the anode 23 side as processing for suppressing the secondary electron emission. Even when a film 21*c* capable of emitting secondary electrons is formed on the surface of the gate electrode 21 on the anode 23 side by using a manufacturing method of forming the photocathode 20 by way of the opening 21*a* of the gate electrode 21 from the anode 23 side, this configuration can lower the secondary electron emitting capability and effectively suppress the occurrence of unnecessary secondary electrons due to ions.

Examples of the material lowering the secondary electrode emitting capability include gold, silver, and platinum. When the film 21*d* is formed by such a material, the film 21*c* of antimony or the like vapor-deposited on the surface of the gate electrode 21 on the anode 23 side is alloyed with the material of the film 21*d*. This fully lowers the secondary electron emitting capability of the alloyed films 21*c*, 21*d* as a whole.

Figure 5:
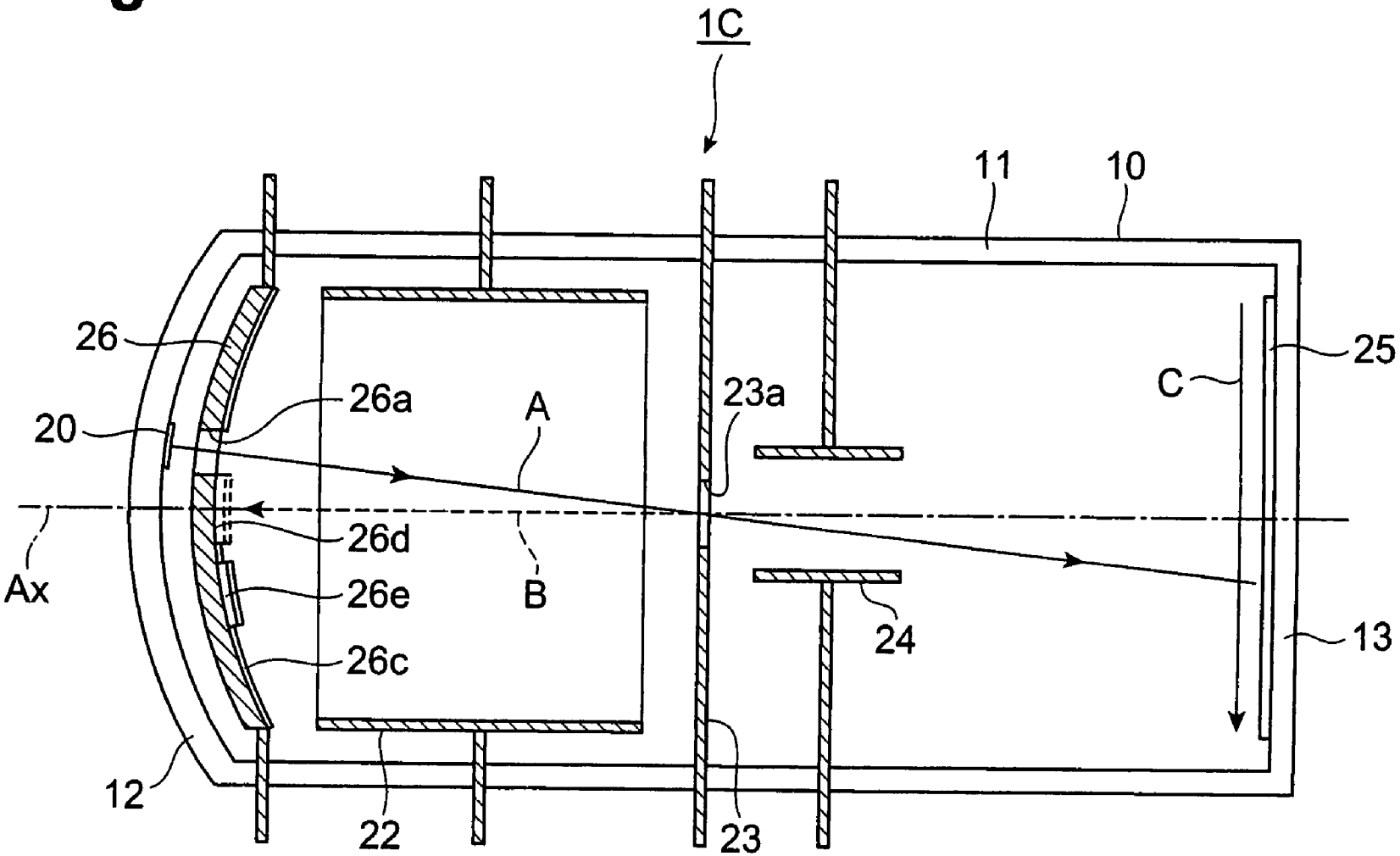
FIG. 5 is a side sectional view showing a configuration of a third embodiment of the streak tube.

FIG. 5 is a side sectional view showing the configuration of a third embodiment of the streak tube in accordance with the present invention. Configurations of an envelope 10, a photocathode 20, a converging electrode 22, an anode 23, deflecting electrodes 24, and a fluorescent screen 25 in the streak tube 1C in accordance with this embodiment are the same as those in the streak tube 1A shown in FIG. 1.

A gate electrode 26 is provided between the photocathode 20 and the anode 23. The gate electrode 26 has an opening 26*a* for passing there through an electron emitted from the photocathode 20 and is arranged at a predetermined position between the photocathode 20 and the converging electrode 22. In this streak tube 1C, the opening 26*a* of the gate electrode 26 is formed at a predetermined part excluding the intersection with the axis Ax.

Further, in this embodiment, a movable cover member 26*e* is provided on the surface of the gate electrode 26 on the anode 23 side. The cover member 26*e* is positioned at a part including the intersection with the axis Ax as indicated by dotted lines in FIG. 5 at the time of manufacturing the photocathode 20, and is moved to a position indicated by solid lines after manufacturing the photocathode 20. In such a configuration, even when a film 26*c* capable of emitting secondary electrons is formed on the surface of the gate electrode 26 on the anode 23 side by using a manufacturing method of forming the photocathode 20 by way of the opening 26*a* of the gate electrode 26 from the anode 23 side, the part 26*d* including the intersection with the axis Ax where the cover member 26*e* is positioned at the time of manufacturing the photocathode 20 exposes the surface of the gate electrode 26 without being formed with the film 26*c*. This can effectively suppress the occurrence of unnecessary secondary electrons due to ions.

In such a configuration, a film made of a material having a low secondary electron emission capability may be formed on the surface of the gate electrode 26 on the anode 23 side within the part 26*d* as processing for suppressing the secondary electron emission. This can further suppress the occurrence of unnecessary secondary electrons due to ions. Examples of the material having such a low secondary electron emission capability include light elements such as carbon.

Figure 6:
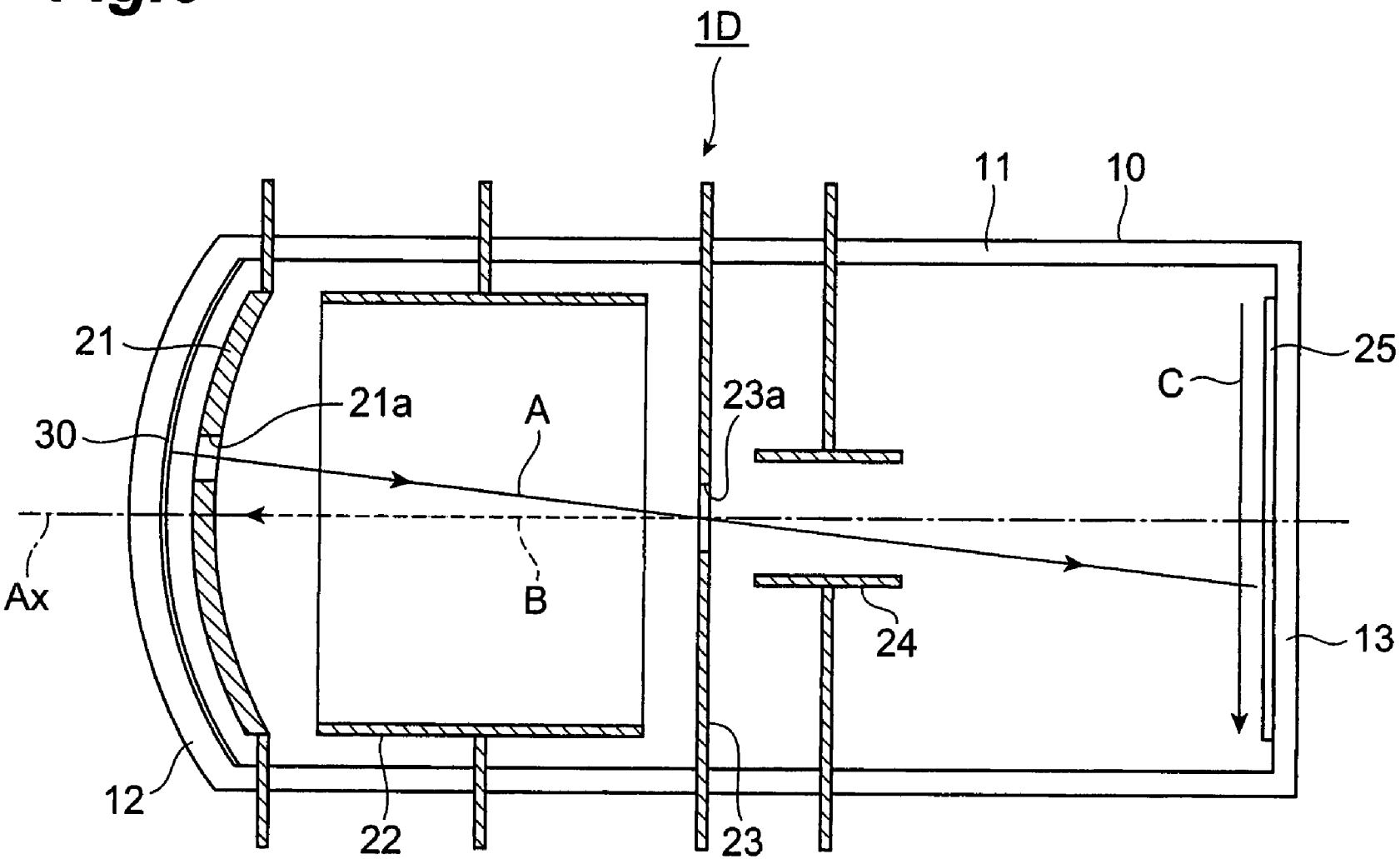
FIG. 6 is a side sectional view showing a configuration of a fourth embodiment of the streak tube.

FIG. 6 is a side sectional view showing the configuration of a fourth embodiment of the streak tube in accordance with the present invention. Configurations of an envelope 10, a gate electrode 21, a converging electrode 22, an anode 23, deflecting electrodes 24, and a fluorescent screen 25 in the streak tube 1D in accordance with this embodiment are the same as those in the streak tube 1A shown in FIG. 1.

A photocathode 30 is formed on the inner face of the entrance faceplate 12. Here, the photocathode 30 is formed on the whole inner face of the entrance faceplate 12 including the intersection with the axis Ax. Though the photocathode 30 is formed at the part including the intersection with the axis Ax, the opening 21*a* of the gate electrode 21 is formed at a predetermined part excluding the intersection with the axis Ax, whereby the photocathode 30 does not directly face the anode 23 on the axis Ax (electric field axis or tube axis) in this configuration. Such a configuration can also effectively suppress the occurrence of unnecessary secondary electrons due to ions.

In such a configuration, the photocathode 30 can be formed by a manufacturing method using a transfer apparatus, for example. Therefore, the film 21*c* on the surface of the gate electrode 21 on the anode 23 side is not formed by the above-mentioned manufacturing method and thus is not shown in FIG. 6.

Figure 7:
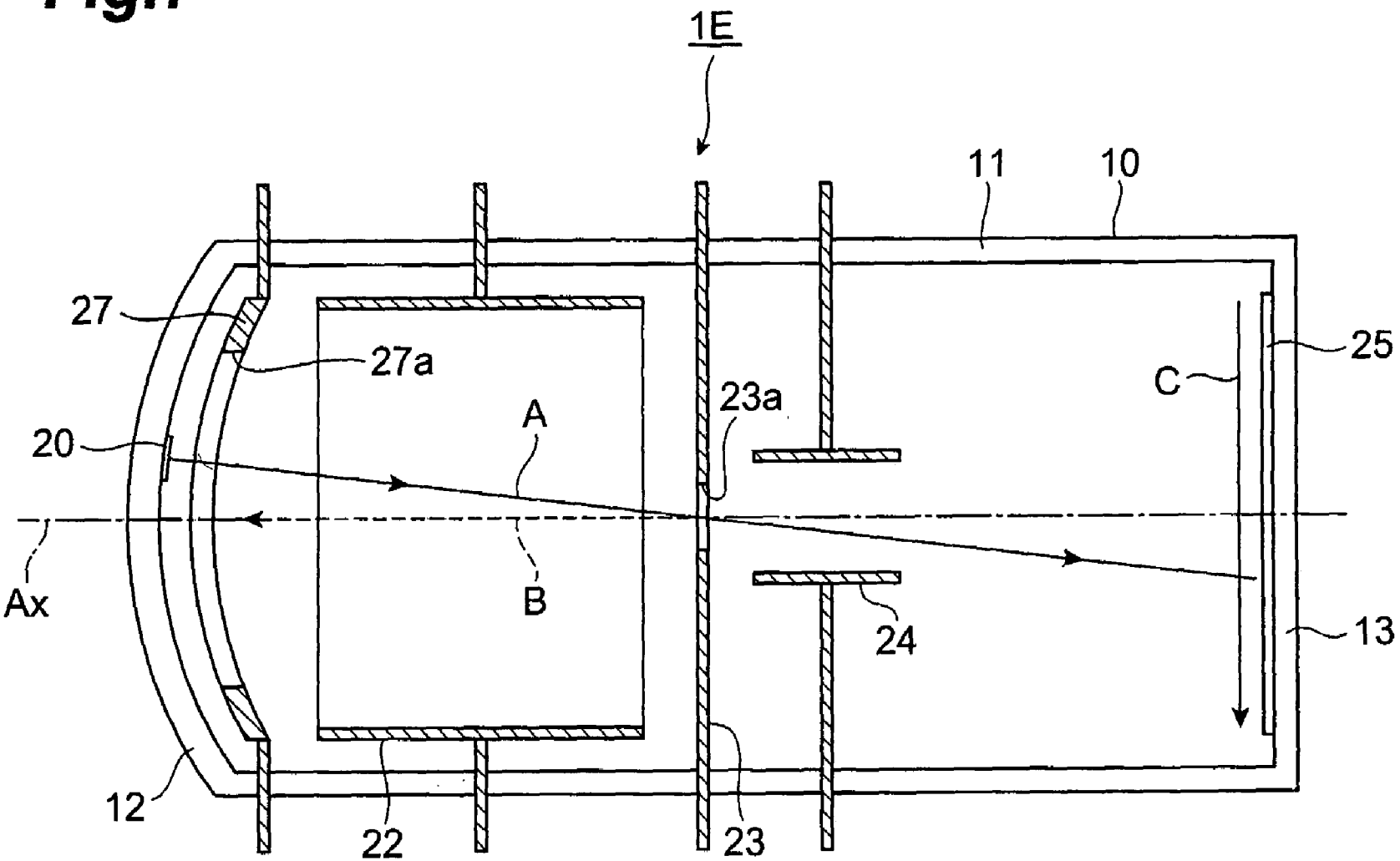
FIG. 7 is a side sectional view showing a configuration of a fifth embodiment of the streak tube.

FIG. 7 is a side sectional view showing the configuration of a fifth embodiment of the streak tube in accordance with the present invention. Configurations of an envelope 10, a photocathode 20, a converging electrode 22, an anode 23, deflecting electrodes 24, and a fluorescent screen 25 in the streak tube 1E in accordance with this embodiment are the same as those in the streak tube 1A shown in FIG. 1.

A gate electrode 27 is provided between the photocathode 20 and the anode 23. The gate electrode 27 has an opening 27*a* for passing there through an electron emitted from the photocathode 20 and is arranged at a predetermined position between the photocathode 20 and the converging electrode 22. Here, the opening 27*a* of the gate electrode 27 is formed at a relatively wide area including the intersection with the axis Ax. Though the opening 27*a* of the gate electrode 27 is formed at a part including the intersection with the axis Ax, the photocathode 20 is formed at a predetermined part excluding the intersection with the axis Ax and thus does not directly face the anode 23 on the axis Ax (electric field axis or tube axis) in this configuration. Such a configuration can also effectively suppress the occurrence of unnecessary secondary electrons due to ions.

Without being restricted to the above-mentioned embodiments, the streak tube in accordance with the present invention can be modified in various manners. For example, specific arrangement and configurations of individual electrodes in the envelope are not limited to those shown in FIG. 1 and the like, whereby various configurations may be used.

Here, it is preferable that a streak tube comprises (1) an envelope including an entrance faceplate for entering light to be detected; (2) a photocathode, disposed within the envelope, for converting the light received from the entrance faceplate into an electron; (3) an anode having an opening for passing there through the electron emitted from the photocathode; (4) a deflecting electrode for controlling a deflection of the electron having passed through the opening of the anode; and (5) detecting means for detecting a streak image due to the electron having the deflection controlled by the deflecting electrode after being emitted from the photocathode; (6) wherein the photocathode is configured so as to be kept from directly facing the anode on an axis of an electric field formed between the entrance faceplate and the anode within the envelope.

In another aspect, it is preferable that a streak tube comprises (1) an envelope including an entrance faceplate for entering light to be detected; (2) a photocathode, disposed within the envelope, for converting the light received from the entrance faceplate into an electron; (3) an anode having an opening for passing there through the electron emitted from the photocathode; (4) a deflecting electrode for controlling a deflection of the electron having passed through the opening of the anode; and (5) detecting means for detecting a streak image due to the electron having the deflection controlled by the deflecting electrode after being emitted from the photocathode; (6) wherein the photocathode is configured so as to be kept from directly facing the anode on a tube axis passing a center of the opening of the anode within the envelope.

As a specific example of configurations of the above-mentioned streak tube, one in which the photocathode is formed at a predetermined part excluding an intersection with a predetermined axis (electric field axis or tube axis) on the surface of the entrance faceplate on the anode side can be used.

The streak tube may comprise a control electrode, disposed between the photocathode and the anode, having an opening for passing there through the electron emitted from the photocathode and controlling a condition for passing the electron from the photocathode to the anode. An example of the control electrode is a gate electrode which controls a gate operation for detecting the streak image by applying a gate voltage.

When the control electrode is thus provided, a configuration in which the opening of the control electrode is formed at a predetermined part excluding an intersection with a predetermined axis (electric field axis or tube axis) can be used as a specific example of configurations of the above-mentioned streak tube.

Preferably, a surface of the control electrode on the anode side is processed for suppressing a secondary electron emission. This can restrain unnecessary secondary electrons due to ions in the control electrode from occurring and suppress the influence of noise signals on signals corresponding to the incident light.

The streak tube in accordance with the present invention is utilizable as a streak tube which can suppress influences of noise signals on signals corresponding to incident light.

What is claimed is:

1. A streak tube comprising:

an envelope including an entrance faceplate for entering light to be detected, and a tubular part whose center axis is a tube axis;

a photocathode, disposed within the envelope, for converting the light received from the entrance faceplate into an electron;

an anode placed perpendicular to the tube axis and having an opening for passing there through the electron emitted from the photocathode, the opening being a single opening and having a form employing the tube axis as a center axis;

a deflecting electrode for controlling a deflection of the electron having passed through the opening of the anode; and detecting means for detecting a streak image due to the electron having the deflection controlled by the deflecting electrode after being emitted from the photocathode;

wherein the photocathode is configured so as to be kept from directly facing the anode on an axis of an electric field formed between the entrance faceplate and the anode within the envelope, and the photocathode is visible from the opening of the anode as seen on a straight line different from the axis of the electric field, and the streak tube further comprising a control electrode, having a blocking portion disposed between the photocathode and the anode, and an opening for passing there through the electron emitted from the photocathode and controlling a condition for passing the electron from the photocathode to the anode, and the opening of the control electrode is formed at a predetermined part of the blocking portion excluding an intersection with the axis of the electric field, so that a straight path along the axis of the electric field between the photocathode and the anode is blocked by the blocking portion.

2. A streak tube according to claim 1, wherein the photocathode is formed at a predetermined part excluding an intersection with the axis of the electric field on a surface of the entrance faceplate on the anode side.

3. A streak tube according to claim 1, wherein a surface of the control electrode on the anode side is processed for suppressing a secondary electron emission.

4. A streak tube comprising:

an envelope including an entrance faceplate for entering light to be detected, and a tubular part whose center axis is a tube axis;

a photocathode, disposed within the envelope, for converting the light received from the entrance faceplate into an electron;

an anode placed perpendicular to the tube axis and having an opening for passing there through the electron emitted from the photocathode, the opening being a single opening and having a form employing the tube axis as a center axis;

a deflecting electrode for controlling a deflection of the electron having passed through the opening of the anode; and detecting means for detecting a streak image due to the electron having the deflection controlled by the deflecting electrode after being emitted from the photocathode;

wherein the photocathode is configured so as to be kept from directly facing the anode on the tube axis passing a center of the opening of the anode within the envelope, and the photocathode is visible from the opening of the anode as seen on a straight line different from the tube axis, and the streak tube further comprising a control electrode, having a blocking portion disposed between the photocathode and the anode, and an opening for passing there through the electron emitted from the photocathode and controlling a condition for passing the electron from the photocathode to the anode, and the opening of the control electrode is formed at a predetermined part of the blocking portion excluding an intersection with the tube axis, so that a straight path along the tube axis between the photocathode and the anode is blocked by the blocking portion.

5. A streak tube according to claim 4, wherein the photocathode is formed at a predetermined part excluding an intersection with the tube axis on a surface of the entrance faceplate on the anode side.

6. A streak tube according to claim 4, wherein a surface of the control electrode on the anode side is processed for suppressing a secondary electron emission.

* * * * *